US007658637B2

(12) United States Patent
Matsuzawa

(10) Patent No.: US 7,658,637 B2
(45) Date of Patent: Feb. 9, 2010

(54) CONNECTOR HAVING COUPLING GUIDES FOR ESTABLISHING CONNECTION WITH MEMORY CONNECTOR AT RIGHT POSITION

(75) Inventor: Hiroki Matsuzawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 12/232,828

(22) Filed: Sep. 25, 2008

(65) Prior Publication Data

US 2009/0104810 A1 Apr. 23, 2009

(30) Foreign Application Priority Data

Oct. 22, 2007 (JP) ..... 2007-274299

(51) Int. Cl.
*H01R 13/64* (2006.01)

(52) U.S. Cl. ..... 439/377

(58) Field of Classification Search ..... 439/377, 439/378, 64, 374, 680
See application file for complete search history.

(56) References Cited

U.S. PATENT DOCUMENTS 5,581,127 A * 12/1996 Shinohara ..... 257/679
7,090,521 B2 8/2006 Nishio et al.

FOREIGN PATENT DOCUMENTS

| | | |
|---|---|---|
| JP | A-H5-129481 | 5/1993 |
| JP | A-H5-205939 | 8/1993 |
| JP | A-H8-185924 | 7/1996 |
| JP | A-H9-320684 | 12/1997 |
| JP | A-2000-100501 | 4/2000 |
| JP | A-2003-173423 | 6/2003 |
| JP | A-2007-035376 | 2/2007 |

* cited by examiner

*Primary Examiner*—Ross N Gushi
(74) *Attorney, Agent, or Firm*—Posz Law Group, PLC

(57) ABSTRACT

A connector installed in a casing containing an electronic device such as a car navigation device is coupled to another connector installed in a memory device such as a hard disc. The connector includes a support member composed of a back plate and side plates connected to the back plate. The connector is disposed on the back plate, and coupling guides to be coupled to guiding grooves formed on the memory device are formed integrally with the side plates. The coupling guides are slid into the guiding grooves to correctly position the connector relative to the memory-side connector when the memory device is coupled to the casing containing the connector. Thus, the connector is surely coupled to the memory-side connector at a right position to establish electrical connection between two connectors.

4 Claims, 5 Drawing Sheets

CONNECTOR HAVING COUPLING GUIDES FOR ESTABLISHING CONNECTION WITH MEMORY CONNECTOR AT RIGHT POSITION

CROSS-REFERENCE TO RELATED APPLICATION

This application is based upon and claims benefit of priority of Japanese Patent Application No. 2007-274299 filed on Oct. 22, 2007, the content of which is incorporated herein by reference.

BACKGROUND OF THE INVENTION

1. Field of the Invention

The present invention relates to a connector having coupling guides for establishing connection with a second connector (a connector installed in a memory connector) at a right position.

2. Description of Related Art

A connector installed in an electronic device such as a car navigation system is often connected to another connector of a memory device such as a hard disc. A guide for connecting two connectors at a right position is conventionally provided. An example of a conventional connector having such a guide is shown in FIGS. 1 and 2 attached hereto. A pair of coupling guides 21 is provided in a casing 20 that contains a connector 31 therein. A pair of guiding grooves 12 is provided on a memory device 10 to be coupled with the casing 20. The casing 20 also includes a substrate 30 to which the connector 31 is electrically connected. The memory device 10 has a connector 11 (referred to as a memory-side connector) to be connected to the connector 31. The memory device 10 is coupled to the casing 20 by slidably inserting the coupling guides 21 into the guiding grooves 12. When the memory device 10 is slid to a predetermined position, the connector 31 is electrically connected to the memory-side connector 11.

If a position of the memory-side connector 11 does not match a position of the connector 31, individual terminals of both connectors 11, 31 are not correctly connected to one another. This causes fault electrical connections or imposes an excessive force on soldered positions of the terminals. To cope with this problem, JP-A-9-320684 proposes to provide a connector that includes coupling guides. The coupling guide is composed of a square hole provided in a female connector and a projected rod provided in a male connector. On the other hand, JP-A-8-185924 proposes to provide a separate component for establishing connection of two connectors at a right position.

However, some problems are involved in those proposed devices. In the device proposed by JP-A-9-320684, a position of the square hole relative to the female connector has a certain dimensional deviation. A position of the rod relative to the male connector also includes a certain deviation. Because of these deviations, two connectors may not be coupled correctly at a right position.

Referring to FIG. 2, an amount of a possible positional mismatch between two connectors shown in FIG. 1 will be explained. Dimensions A-F and deviations a-f shown in FIG. 2 show the followings: "A" is a distance between both coupling guides 21 and "a" is a deviation thereof; "B" is a width of the coupling guide 21 and "b" is a deviation thereof; "C" is a distance between an inside surface of the coupling guide 21 and a position of a member fixing the connector 31 on the substrate 30 (such as a screw) and "c" is a deviation thereof; "D" is a distance between the position of the fixing member to a center of the connector 31 and "d" is a deviation thereof; "E" is a distance between bottom surfaces of both guiding grooves 12 and "e" is a deviation thereof; and "F" is a distance between the bottom surface of the guiding groove 12 and a center of the connector 11. All of the deviations a-f affect the position of either one of the connectors 11, 31. If it is assumed that each deviation a-f is 0.2 mm, a maximum positional deviation between two connectors 11, 31 reaches 1.2 mm, which is an accumulated amount of all of the deviations a-f. If a position of the memory-side connector 11 relative to the connector 31 cannot be adjusted to cover an actual positional deviation between two connectors, two connectors may not be correctly connected.

On the other hand, in the device proposed by JP-A-8-185924, a guiding member for coupling connectors at a right position is provided separately from the connectors. Therefore, there is a possibility that connectors may not be coupled to each other because of excessive dimensional deviations of components. In addition, the device becomes expensive because the separate guiding member has to be provided.

SUMMARY OF THE INVENTION

The present invention has been made in view of the above-mentioned problems, and an object of the present invention is to provide an improved connector that can be correctly coupled to another connector installed in a memory device.

The connector of the present invention is disposed in a casing containing an electronic device such as a car navigation device. The connector is coupled to a memory side connector installed in a memory device such as a hard disc. The connector includes a support member having a back plate and a pair of side plates connected to the back plate. The connector is disposed on the back plate, and coupling guides integrally formed with the support member are disposed on the side plates. The coupling guides are coupled to guiding grooves formed on the memory device, to thereby position the connector correctly relative to the memory-side connector.

The coupling guide is formed in an elongated rectangular pillar shape, and the guiding groove formed on the memory device is shaped in a rectangular groove corresponding to the rectangular pillar. In a process of coupling the memory device to the casing that contains the connector, the coupling guides are aligned to the guiding grooves, and the memory device is pushed toward the casing along the coupling guides. In this manner, the memory-side connector is correctly coupled to the connector at a right position. Since the coupling guide is integrally formed with the connector, a positional mismatch between both connectors is minimized.

In addition to the coupling guides, additional guides to be coupled to additional guiding structures formed on the memory device may be made in the vicinity of the coupling guides to thereby further improve positional matching between two connectors. A floating structure for adjusting a positional relation between the connector and the memory-side connector may be disposed between both connectors.

According to the present invention, the connector is surely connected to the memory-side connector without using a separate member for matching the positions of both connectors. Other objects and features of the present invention will become more readily apparent from a better understanding of the preferred embodiment described below with reference to the following drawings.

DETAILED DESCRIPTION OF THE PREFERRED EMBODIMENT

Figure 1:
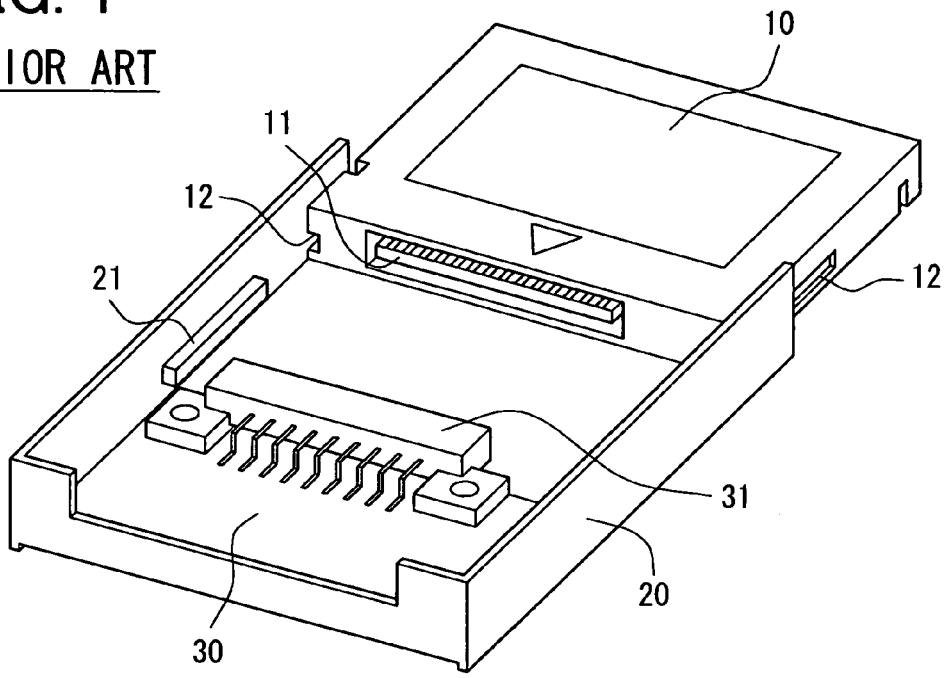
FIG. 1 PRIOR ART
FIG. 1 is a perspective view showing a conventional connector having coupling guides separately made from the connector.

A preferred embodiment of the present invention will be described with reference to FIGS. 3 and 4. First, referring to FIG. 3, a connector 40 to be coupled to another connector 11 (referred to as a memory-side connector) installed in a memory device 10 such as a hard disc will be described. The hard disc may be replaced with a USB memory. The connector 40 is mounted on a casing 22 containing an electronic device such as a car navigation device. The connector 40 has plural terminals to be coupled and electrically connected to the memory-side connector 11.

The casing 22 is composed of an end wall 222, a bottom wall 221 and a pair of sidewalls 223 connected to the end wall 222 and the bottom wall 221 at a right angle. An opposite side to the end wall 222 is an opening through which the memory device 10 is slidably coupled to the casing 22. The connector 40 composed of a support member 401 and a coupler 42 containing terminals 422 (refer to FIG. 4) is mounted on the casing 22 with screws or the like (not shown) inserted into mounting holes 41. A substrate 30 having electronic components disposed thereon is installed on the bottom wall 221 of the casing 22 and electrically connected to the connector 40.

Figure 4:
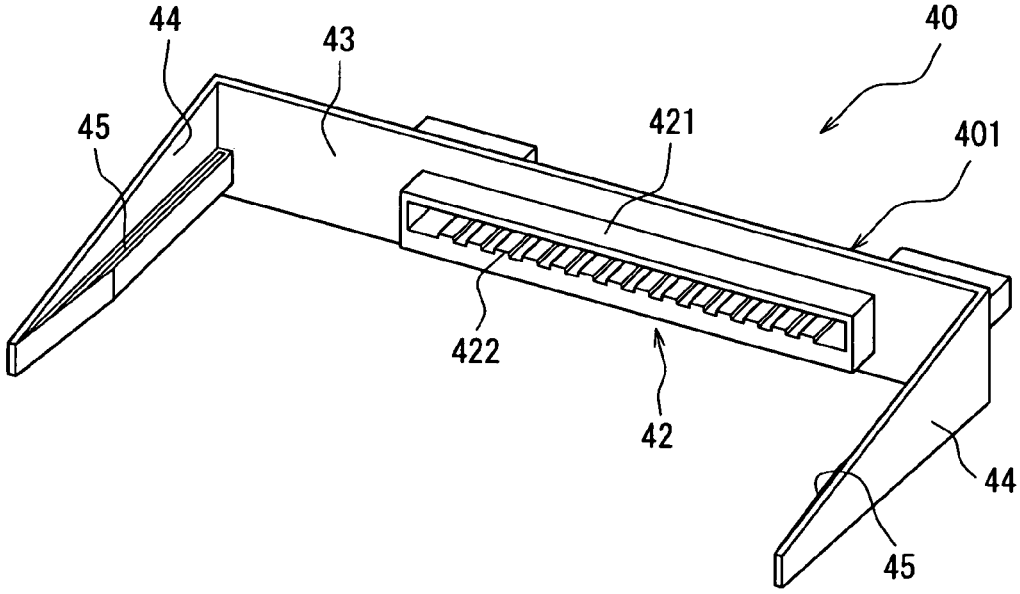
FIG. 4 is a perspective view showing the connector shown in FIG. 3 in an enlarged scale.

Referring to FIG. 4 showing the connector 40 in an enlarged scale, the connector 40 will be further described. The support member 401 is composed of a back plate 43, on which the coupler 42 of the connector is connected, and a pair of side plates 44 connected to the back plate 43 at a right angle. The coupler 42 includes a housing 421 and plural terminals 422 to be electrically connected to terminals of the memory-side connector 11. The support member 401 may be made of a resin or metallic material. It is also possible to cover a resin-made support member 401 with a metallic material to make the connector 40 shielded.

A coupling guide 45 is formed on an inside surface of each side plate 44. The coupling guide 45 is shaped in a rectangular pillar. A tip of the coupling guide 45 is made thinner so that it is easily coupled to a guiding groove 12 (refer to FIG. 3) formed on each side of the memory device 10. The coupling guide 45 is formed in a trapezoidal shape as a whole as shown in FIG. 4. The pair of coupling guides 45 is integrally formed with the support member 401. The guiding groove 12 has a rectangular cross-section corresponding to the shape of the coupling guide 45.

Figure 3:
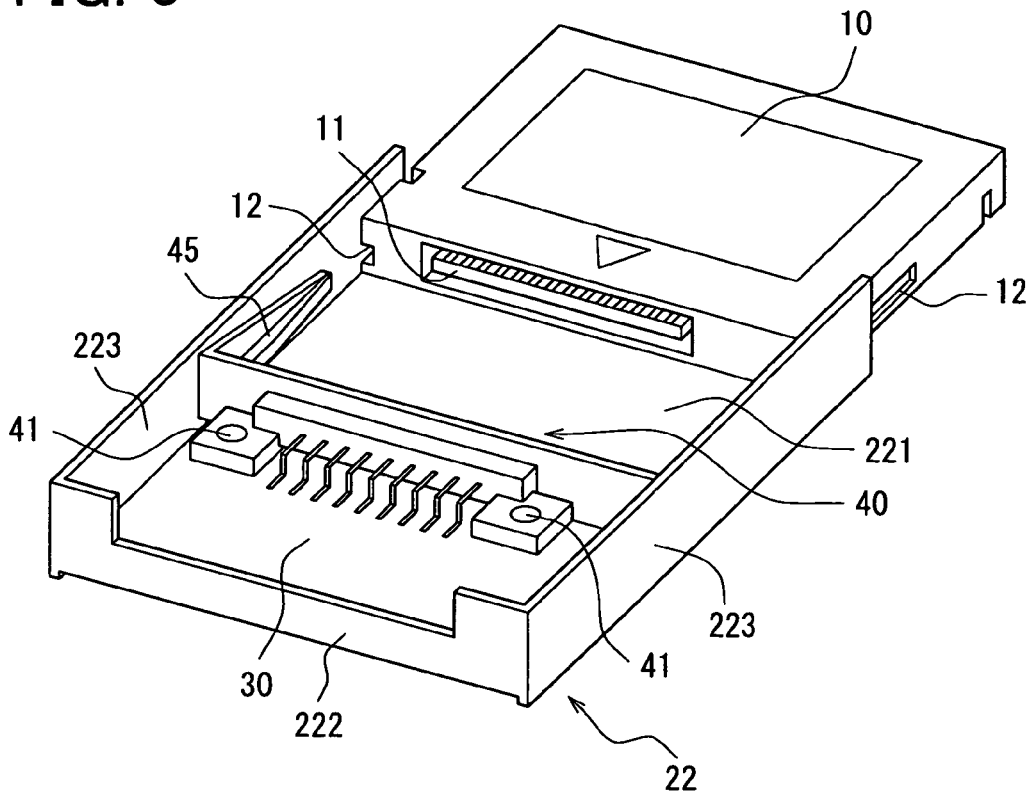
FIG. 3 is a perspective view showing a connector to be coupled to a memory-side connector according to the present invention.

The outer surfaces of the side plates 44 are positioned in contact with inner surfaces of the sidewalls 223 of the casing 22, as shown in FIG. 3. The connector 40 having the support member 401 is connected to the casing 22 by fixing members inserted into the mounting holes 41. The memory device 10 is coupled to the connector 40 in the following manner. First, tips of the coupling guides 45 are aligned with the ends of the guiding grooves 12. Then, the memory device 10 is slidably pushed toward the connector 40 along the coupling guides 45 until the memory-side connector 11 is firmly coupled to the connector 40.

Figure 2:
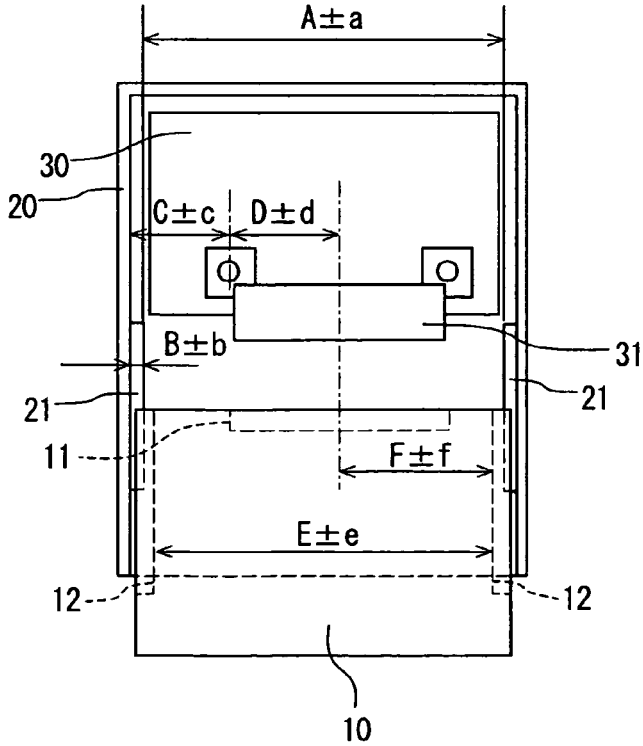
FIG. 2 PRIOR ART
FIG. 2 is a plan view showing the conventional connector shown in FIG. 1 for explaining dimensional deviations in two connectors.
Figure 5:
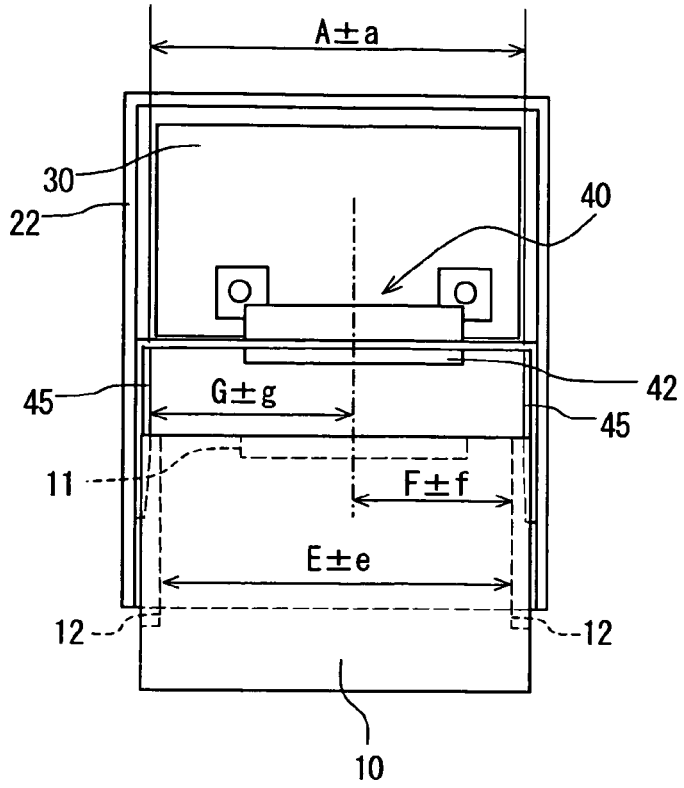
FIG. 5 is a plan view showing the connector shown in FIG. 3 for explaining dimensional deviations in two connectors.

Referring to FIG. 5, a deviation of the position of the connector 40 relative to memory-side connector 11 will be explained. The dimensions A, E and F in FIG. 5 are the same as those in FIG. 2, and the deviations a, e and f are also the same as those in FIG. 2. "G" is a distance from the coupling guide 45 to a center of the connector 40. Four deviations a, e, f, and g affect the position of either one of the connectors 11, 40. If the maximum amount of four deviations a, e, f, g is 0.2 mm as in the conventional connector shown in FIG. 2, the maximum positional deviation between the connector 40 and the memory-side connector 11 is 0.8 mm. This means that the maximum deviation is improved by 0.4 mm in this embodiment, compared with that of the conventional connector.

As described above, the coupling guides 45 are integrally formed with the connector 40 in this embodiment. Therefore, the position of the coupler 42 relative to the coupling guide 45 can be made with a less deviation. Accordingly, the memory-side connector 11 can be coupled to the connector 40 at a right position. As a result, both connectors 11, 40 are properly connected without using separate members for adjusting the relative position between the connector 40 and the memory-side connector 11.

Figure 6:
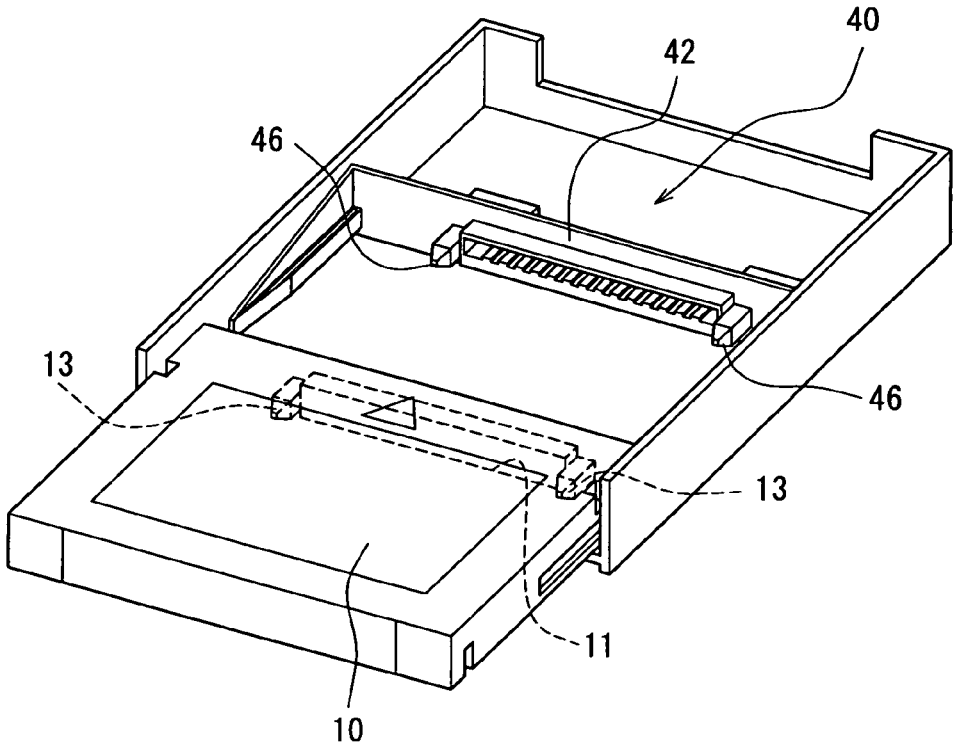
FIG. 6 is a perspective view showing a modified form of a connector having additional coupling guides.

The present invention is not limited to the embodiment described above, but it may be variously modified. For example, as shown in FIG. 6, a pair of projections 46 to be coupled to a pair of coupling holes 13 may be formed next to or in the vicinity of the coupler 42 of the connector 40. The coupling holes 13 are formed next to or in the vicinity of the memory-side connector 11. In this manner, the relative position between the connector 40 and the memory-side connector 11 can be further improved.

Figure 7:
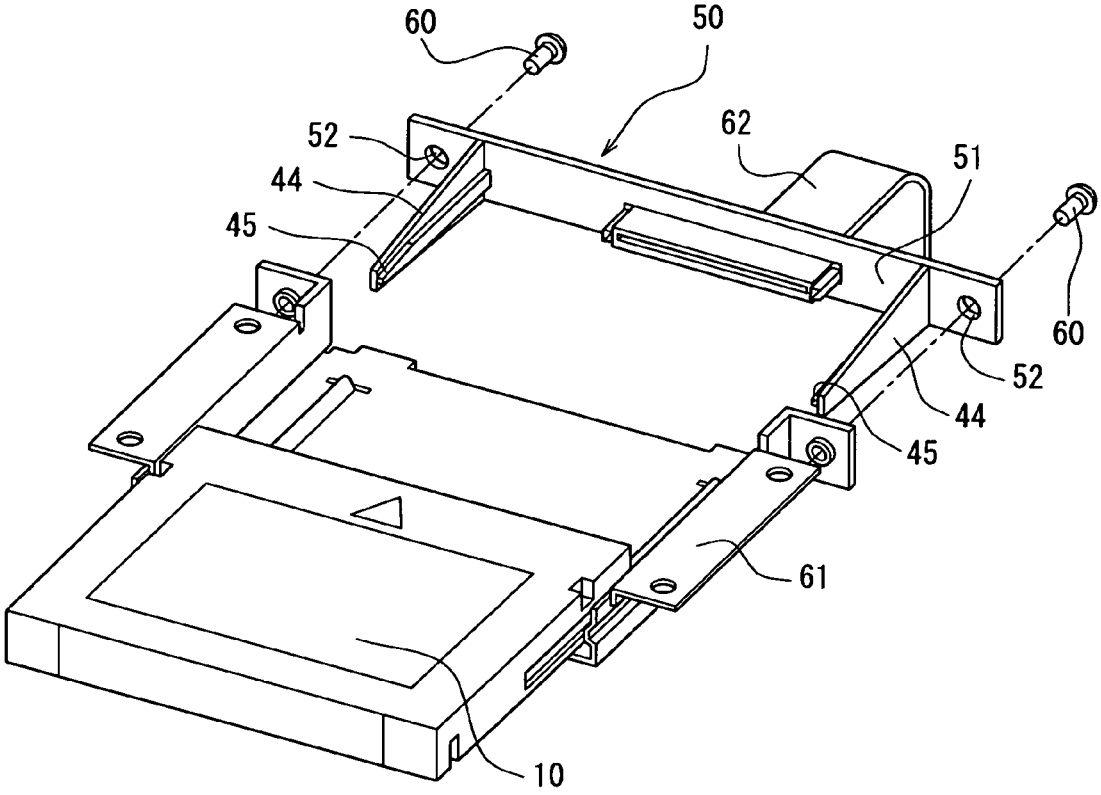
FIG. 7 is a perspective view showing another modified form of connector having a floating structure.
Figure 8:
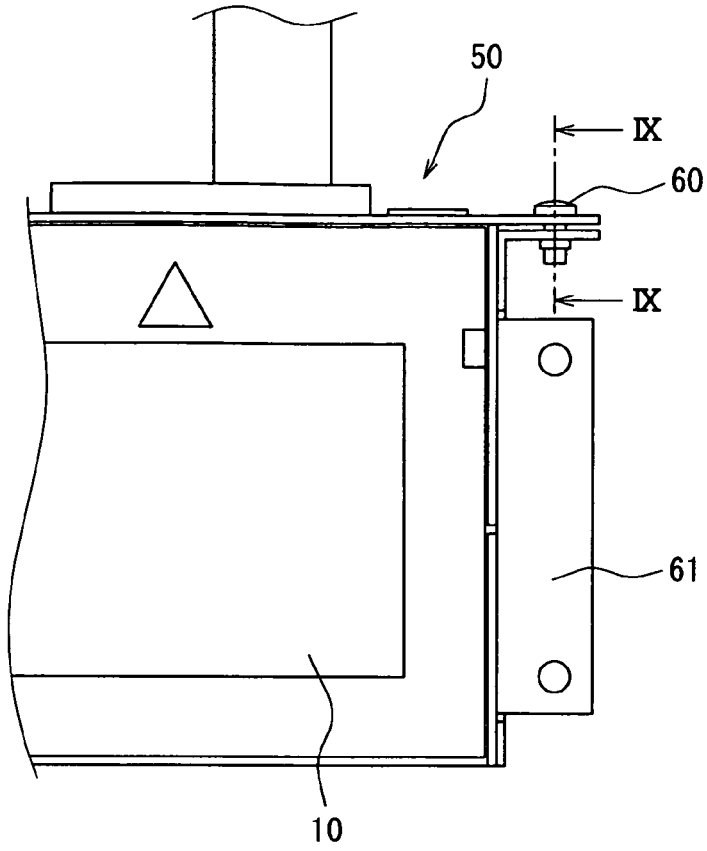
FIG. 8 is a plan view showing the floating structure shown in FIG. 7 in an enlarged scale.
Figure 9:
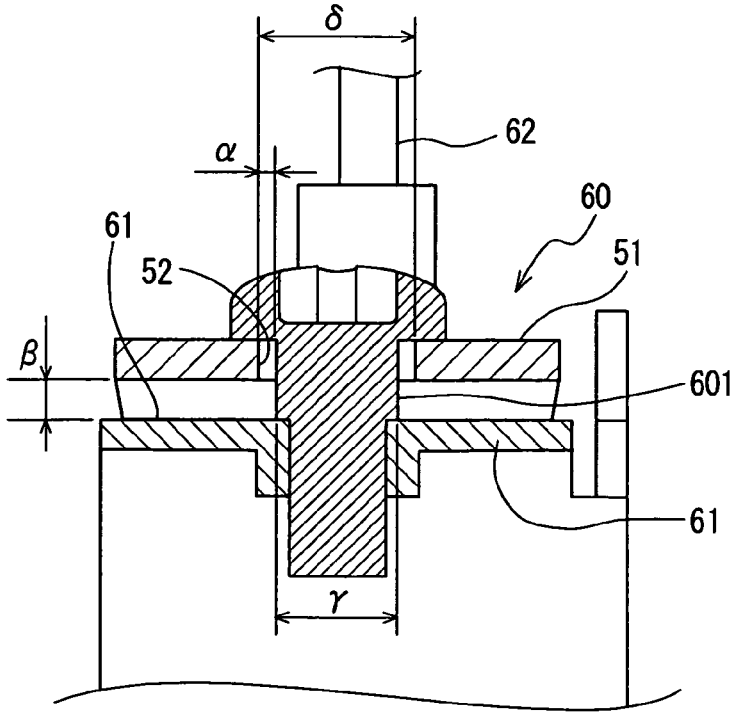
FIG. 9 is a cross-sectional view showing the floating structure, taken along line IX-IX shown in FIG. 8.

As shown in FIGS. 7-9, a floating structure may be provided between the connector and the memory device. As shown in FIG. 8, a connector 50 (a modified form of the connector 40 described above) electrically connected to a wire harness 62 includes a back plate 51 and side plates 44 on which the coupling guides 45 are formed. A frame 61 for carrying the memory device 10 thereon is connected to the back plate 51 of the connector 50 with stepped screws 60 inserted into through-holes 52, so that the connector 50 laterally moves relative to the frame 61.

As shown in FIG. 9, the through-hole 52 (diameter $\delta$) is made larger than a large-diameter portion 601 (diameter $\gamma$), thereby making a clearance $\alpha$ ($=\frac{1}{2}(\delta-\gamma)$) between the back plate 51 and the frame 61. Further, another clearance $\beta$ is formed between the back plate 51 and the frame 61 by disposing the frame 61 on a shoulder of the stepped screw 60. In this manner, the connector 50 is laterally movable relative to the memory-side connector 11 even after the connector 50 is connected to the frame 61. The connector 50 is coupled to the memory device 10 by inserting the coupling guides 45 into the coupling grooves 12 in the same manner as in the foregoing embodiment. Since the connector 50 is laterally movable relative to the memory-side connector 11 (referred to as the floating structure), both connectors 11, 50 are correctly coupled even though there is a small mismatch between them.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A connector to be coupled to a memory-side connector installed in a memory device, the connector comprising:

a support member on which the connector is disposed;

coupling guides integrally formed with the support member, the coupling guides being adapted to be coupled to a guiding structure formed on the memory device; and a frame that receives the memory device, wherein the support member is formed with a through hole and is coupled to the frame with a screw, which is inserted into the through hole, such that relative movement is allowed between the support member and the frame.

2. The connector as in claim 1, further including additional coupling guides formed on the support member in the vicinity of the connector disposed on the support member, the additional coupling guides being adapted to be coupled to an additional guiding structure formed on the memory device.

3. The connector as in claim 1, wherein:

the support member includes a back plate on which the connector is disposed and a pair of side plates connected to the back plate; and each coupling guide is formed on each side plate.

4. The connector as in claim 3, wherein:

the coupling guide is shaped in an elongated rectangular pillar; and the guiding structure formed on the memory device is shaped in a groove corresponding to the rectangular shape of the coupling guide.

* * * * *